US006135636A

United States Patent [19]

Randall

[11] Patent Number: 6,135,636

[45] Date of Patent: Oct. 24, 2000

[54] SLIDING MECHANICAL CLOSURE WITH COLOR POSITION INDICATOR

[75] Inventor: Catherine Jean Randall, Cincinnati, Ohio

[73] Assignee: Procter & Gamble Company, Cincinnati, Ohio

[21] Appl. No.: 09/296,820

[22] Filed: Apr. 22, 1999

[51] Int. Cl.[7] ..... B65D 33/16

[52] U.S. Cl. ..... 383/64

[58] Field of Search ..... 383/61, 63, 64

[56] References Cited

U.S. PATENT DOCUMENTS

| | | | |
|---|---|---|---|
| 3,660,875 | 5/1972 | Gutman | 24/400 |
| 4,186,786 | 2/1980 | Kirkpatrick . | |
| 4,285,105 | 8/1981 | Kirkpatrick | 383/63 X |
| 4,786,190 | 11/1988 | Van Erden et al. . | |
| 4,829,641 | 5/1989 | Williams . | |
| 4,907,321 | 3/1990 | Williams | 383/63 X |
| 5,064,664 | 11/1991 | Hustad . | |
| 5,067,208 | 11/1991 | Herrington, Jr. et al. . | |
| 5,103,979 | 4/1992 | Hustad . | |
| 5,131,121 | 7/1992 | Herrington, Jr. et al. . | |
| 5,161,286 | 11/1992 | Herrington, Jr. et al. . | |
| 5,189,764 | 3/1993 | Herrington et al. . | |
| 5,248,201 | 9/1993 | Kettner et al. . | |
| 5,301,394 | 4/1994 | Richardson et al. . | |
| 5,301,395 | 4/1994 | Richardson et al. . | |
| 5,356,222 | 10/1994 | Kettner et al. . | |
| 5,442,837 | 8/1995 | Morgan . | |
| 5,470,156 | 11/1995 | May . | |
| 5,474,382 | 12/1995 | May . | |
| 5,486,051 | 1/1996 | May . | |
| 5,489,252 | 2/1996 | May . | |
| 5,509,735 | 4/1996 | May . | |
| 5,513,915 | 5/1996 | May . | |
| 5,527,112 | 6/1996 | Dais et al. . | |
| 5,551,127 | 9/1996 | May . | |
| 5,564,834 | 10/1996 | Porchia et al. . | |
| 5,647,671 | 7/1997 | May . | |

*Primary Examiner*—Jes F. Pascua
*Attorney, Agent, or Firm*—Leonard W. Lewis

[57] ABSTRACT

The present invention provides a flexible storage bag having an opening and a color indicating element adjacent to the opening, a mechanical interlocking seal for closing the opening, and a slider for sealing the mechanical interlocking seal. The slider includes an aperture, and the color indicating element is viewable through the aperture when the slider reaches a position along the mechanical interlocking seal to register the aperture with the color indicating element. The color indicating element is preferably positioned adjacent to an end of the mechanical interlocking seal, preferably positioned so as to indicate that the mechanical interlocking seal has been fully closed. The color indicating element may be a plastic insert of a different color than its surroundings or may be printed or painted in place.

10 Claims, 1 Drawing Sheet

SLIDING MECHANICAL CLOSURE WITH COLOR POSITION INDICATOR

FIELD OF THE INVENTION

The present invention relates to sliding mechanical closures such as those commonly employed on flexible storage bags, particularly those suitable for use in the containment and protection of various items including perishable materials.

BACKGROUND OF THE INVENTION

Flexible storage bags for use in the containment and protection of various items, as well as the preservation of perishable materials such as food items, are well known in the art. Such bags typically comprise a rectangular sheet of polymeric film folded upon itself and sealed along two edges to form a semi-enclosed container having two flexible opposed sidewalls, three sealed or folded edges, and one open edge. A closure integrally formed with the bag such as an interlocking rib-type seal or separately provided such as a plastic or paper-clad-wire tie completes the containment assembly.

As utilized herein, the term "flexible" is utilized to refer to materials which are capable of being flexed or bent, especially repeatedly, such that they are pliant and yieldable in response to externally applied forces. Accordingly, "flexible" is substantially opposite in meaning to the terms inflexible, rigid, or unyielding. Materials and structures which are flexible, therefore, may be altered in shape and structure to accommodate external forces and to conform to the shape of objects brought into contact with them without losing their integrity. Flexible storage bags of the foregoing variety are typically formed from polymeric film, such as polyethylene or other members of the polyolefin family, in thicknesses of between about 0.0002 inches to about 0.002 inches. Such films are frequently transparent but sometimes are opaque and/or colored.

Flexible storage bags of the currently commercially available variety provide a means of conveniently storing a wide range of objects and materials in a generally disposable containment device. While flexible storage bags of the foregoing variety have enjoyed a fair degree of commercial success, their reliance upon mechanical closures tends to cause difficulty in operation for individuals having impaired manual dexterity such as children, the elderly, arthritis patients, etc. Moreover, such mechanical closures typically require alignment of mechanical elements for operation which can prove challenging for those with impaired vision or impaired hand-eye coordination.

Flexible storage bags with sliding mechanical closures have been developed to improve the ease of opening and closing mechanical interlocking seals. While such sliding mechanical closures have proven suitable for such uses, there remains the issue of determining whether the slider mechanism has in fact been completely translated across the mouth of the bag to achieve the desired completion of the closing operation.

Accordingly, it would be desirable to provide a sliding mechanical closure which provides for a positive indication of when a complete closure has been achieved.

SUMMARY OF THE INVENTION

The present invention provides a flexible storage bag having an opening and a color indicating element adjacent to the opening, a mechanical interlocking seal for closing the opening, and a slider for sealing the mechanical interlocking seal. The slider includes an aperture, and the color indicating element is viewable through the aperture when the slider reaches a position along the mechanical interlocking seal to register the aperture with the color indicating element.

The color indicating element is preferably positioned adjacent to an end of the mechanical interlocking seal, preferably positioned so as to indicate that the mechanical interlocking seal has been fully closed. The color indicating element may be a plastic insert of a different color than its surroundings or may be printed or painted in place.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
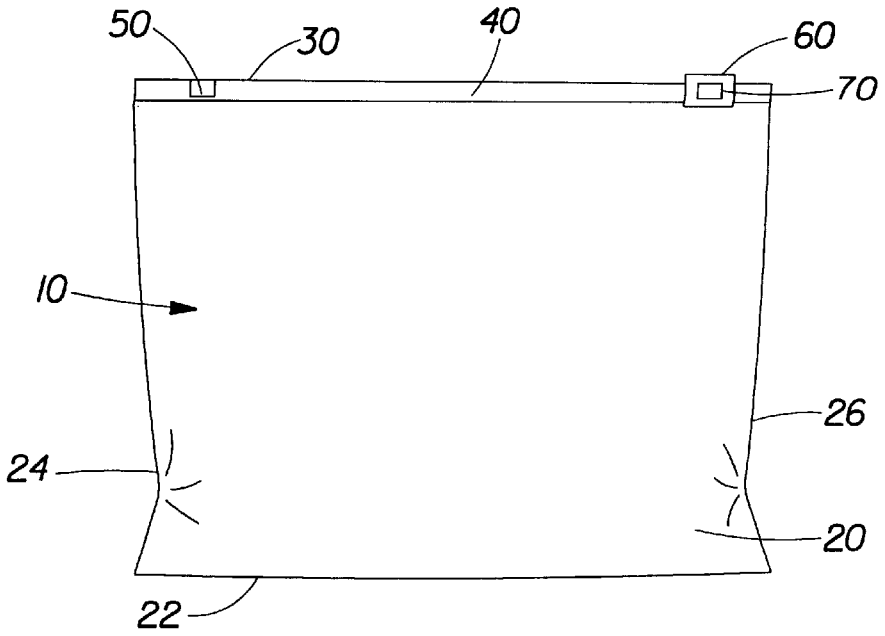
FIG. 1 is an elevational view of a flexible storage bag employing a sliding mechanical closure in accordance with the present invention in an open, empty condition.
Figure 2:
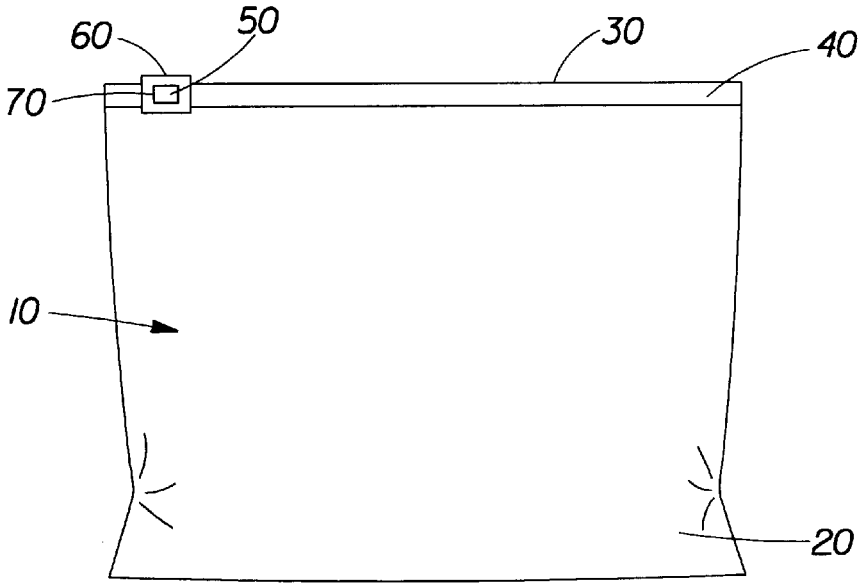
FIG. 2 is an elevational view of the flexible storage bag of FIG. 1 in a fully closed condition.

FIG. 1 depicts a presently preferred embodiment of a flexible storage bag 10 according to the present invention. In the embodiment depicted in FIG. 1, the flexible storage bag 10 includes a bag body 20 formed from a piece of flexible sheet material folded upon itself along fold line 22 and bonded to itself along side seams 24 and 26 to form a semi-enclosed container having an opening along edge 30. Flexible storage bag 10 also includes a mechanical closure 40 located adjacent to edge 30 for sealing edge 30 to form a fully-enclosed container or vessel as shown in FIG. 2. Bags such as the flexible storage bag 10 of FIG. 1 can be also constructed from a continuous tube of sheet material, thereby eliminating side seams 24 and 26 and substituting a bottom seam for fold line 22.

As shown in FIG. 1, the mechanical closure 40 includes an interlocking mechanical seal of any suitable conventional design and a color indicating element 50 located at a given position along the edge 30, preferably adjacent to one end of the edge 30. The color indicating element may be, for example, a plastic insert of a different color than its surroundings and/or than the slider, or may be printed or painted in place. The color indicating element may be visible from one or both sides of the bag. The mechanical closure 40 also includes a slider 60 of suitable conventional design for the type of interlocking mechanical seal employed, but in accordance with the present invention including an aperture or window 70 penetrating at least one side of the slider (two sides if viewing from both sides of the bag is desired). The color indicating element is positioned such that the window in the slider will permit viewing the color indicating element when the window of the slider is registered therewith. The combination of the window in the slider element with the color indicating element provides a means of indicating when the slider has reached a particular location along the edge 30, and when placed adjacent the end of the edge 30 when the slider reaches the end of its travel provides an indication that a fully completed closure operation has been achieved. Multiple color indicating elements may be employed to indicate different positions of the slider.

Various compositions suitable for constructing the flexible storage bags of the present invention include substantially impermeable materials such as polyvinyl chloride (PVC), polyvinylidene chloride (PVDC), polyethylene (PE), polypropylene (PP), aluminum foil, coated (waxed, etc.) and uncoated paper, coated nonwovens etc., and substantially permeable materials such as scrims, meshes, wovens, nonwovens, or perforated or porous films, whether predominantly two-dimensional in nature or formed into three-dimensional structures. Such materials may comprise a single composition or layer or may be a composite structure of multiple materials, including a substrate material utilized as a carrier for a substance.

Once the desired sheet materials are manufactured in any desirable and suitable manner, comprising all or part of the materials to be utilized for the bag body, the bag may be constructed in any known and suitable fashion such as those known in the art for making such bags in commercially available form. Heat or adhesive sealing technologies may be utilized to join various components or elements of the bag to themselves or to each other. In addition, the bag bodies may be thermoformed, blown, or otherwise molded rather than reliance upon folding and bonding techniques to construct the bag bodies from a web or sheet of material. Two recent U.S. Patents which are illustrative of the state of the art with regard to flexible storage bags similar in overall structure to those depicted in FIGS. 1 and 2 but of the types currently available are U.S. Pat. No. 5,554,093, issued Sep. 10, 1996 to Porchia et al., and U.S. Pat. No. 5,575,747, issued Nov. 19, 1996 to Dais et al.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A flexible storage bag comprising:

(a) a bag having an opening and a color indicating element selectively positioned adjacent to said opening;

(b) a mechanical interlocking seal for closing said opening;

(c) a slider for sealing said mechanical interlocking seal, said slider including an aperture;

wherein said color indicating element is viewable through said aperture when said slider reaches a position along said mechanical interlocking seal to register said aperture with said color indicating element and said color indicating element is not viewable through said aperture when said slider reaches another position along said mechanical interlocking seal.

2. The flexible storage bag of claim 1, wherein said color indicating element is positioned adjacent an end of said mechanical interlocking seal.

3. The flexible storage bag of claim 1, wherein said color indicating element comprises a plastic insert of a different color than its surroundings.

4. The flexible storage bag of claim 1, wherein said color indicating element is printed or painted in place.

5. The flexible storage bag of claim 1, wherein said color indicating element is positioned to indicate that said mechanical interlocking seal has been fully closed.

6. The flexible storage bag of claim 1, wherein said color indicating element is a different color from said slider.

7. The flexible storage bag of claim 1, wherein said color indicating element is viewable from one side of said bag.

8. The flexible storage bag of claim 1, wherein said color indicating element is viewable from both sides of said bag.

9. The flexible storage bag of claim 1, wherein said bag includes multiple color indicating elements.

10. The flexible storage bag of claim 1, wherein said slider includes two apertures.

* * * * *